US008418665B2

(12) United States Patent
Kameda et al.

(10) Patent No.: US 8,418,665 B2
(45) Date of Patent: Apr. 16, 2013

(54) VARIABLE PHASE CONTROLLER FOR AUTOMOTIVE ENGINE

(75) Inventors: Michihiro Kameda, Kanagawa (JP); Masayasu Nagado, Kanagawa (JP)

(73) Assignee: Nittan Valve Co., Ltd., Hatanoshi, Kanagawa (JP)

( * ) Notice: Subject to any disclaimer, the term of this patent is extended or adjusted under 35 U.S.C. 154(b) by 407 days.

(21) Appl. No.: 12/988,585

(22) PCT Filed: Apr. 23, 2008

(86) PCT No.: PCT/JP2008/057857

§ 371 (c)(1),
(2), (4) Date: Oct. 19, 2010

(87) PCT Pub. No.: WO2009/130770

PCT Pub. Date: Oct. 29, 2009

(65) Prior Publication Data

US 2011/0036319 A1 Feb. 17, 2011

(51) Int. Cl.
*F01L 1/34* (2006.01)

(52) U.S. Cl.
USPC ..... 123/90.17

(58) Field of Classification Search ..... 123/90.15, 123/90.17; 464/160
See application file for complete search history.

(56) References Cited

U.S. PATENT DOCUMENTS 6,708,657 B2 * 3/2004 Iwaki et al. ..... 123/90.17
6,732,688 B2 * 5/2004 Yamamuro et al. ..... 123/90.17
8,286,602 B2 * 10/2012 Kameda et al. ..... 123/90.17
8,322,319 B2 * 12/2012 Nagado ..... 123/90.17
2003/0226532 A1 12/2003 Takenaka et al.

FOREIGN PATENT DOCUMENTS

DE 10317607 A1 11/2003
JP 2004-003419 A 1/2004
JP 2006-077779 A 3/2006

OTHER PUBLICATIONS

International Search Report of PCT/JP2008/057857, mailing date Jun. 17, 2008.

* cited by examiner

*Primary Examiner* — Thomas Denion
*Assistant Examiner* — Daniel Bernstein
(74) *Attorney, Agent, or Firm* — Westerman, Hattori, Daniels & Adrian, LLP

(57) ABSTRACT

[Problems]
To provide a variable phase controller for an engine which assures easy manufacturing at low cost, reduces operating sound, and includes a relative rotational motion mechanism enabling quick change of a phase angle between a cam shaft and a crank shaft.
[Means for Solving Problems]
A variable phase controller for an engine controls the rotational motion of a first control rotor for changing the relative phase angle between a crank shaft and a cam shaft to either a phase-lead angle side or a phase-lag angle side in accordance with the direction of such control. The variable phase controller has a first braking means for rotating the first control rotor to one side, and a second braking means for braking a second control rotor and rotating the first control rotor in the direction opposite to the rotation caused by the first braking means via a second intermediate rotor (or cam guide plate) displaced by the force applied by a movable element (or rotating eccentric circular cam) displaced in guide grooves by braking of the second control rotor, thereby controlling the rotational motion of the first control rotor.

2 Claims, 18 Drawing Sheets

SECTION F-F

SECTION G-G

SECTION H-H

VARIABLE PHASE CONTROLLER FOR AUTOMOTIVE ENGINE

TECHNICAL FIELD

This invention relates to a variable phase controller for automotive engine for controlling opening/closing timing of valves of the engine using torque means for providing a rotational drum with a torque to vary the rotational phase of the camshaft relative to the sprocket of the engine.

BACKGROUND OF THE INVENTION

A conventional valve timing control apparatus of this type is disclosed in Patent Document 1 below.

The apparatus of the Patent Document 1 referenced below is adapted to advance the phase angle of the camshaft relative to the drive plate 2 (sprocket) driven by the crankshaft of an internal combustion engine in the rotational direction of the drive plate 2 (the direction for advancing the phase will be hereinafter referred to as "phase-lead direction" or phase-lead angle side"), or to delay the phase angle in the opposite direction (the direction will be hereinafter referred to as "phase-lag direction" or phase-lag angle side"), to thereby change the opening/closing timing of valves driven by the cams of the engine.

In the apparatus of Patent Document 1, the drive plate 2 (sprocket) is rotatably mounted on the spacer 8 integral with the camshaft 1. Fixedly secured ahead of the spacer 8, and mounted together with the spacer 8 to the camshaft 1 with a bolt 18, is a lever shaft 13 having three radially extending levers 12. A link arm 14 is rotatably linked at one end thereof to the lever 12 by means of a coupling pin 16, and a movable manipulation member 11 is rotatably mounted to the other end of the arm 14 by means of a coupling pin 17. The drive plate 2 is provided with a radial guide 10 consisting of a pair of parallel guide walls 9*a* and 9*b* each extending in the radial direction. The movable manipulation member 11 is slidably mounted between the guide walls 9*a* and 9*b*. A ball-shaped rotatable member 22 is rollably accommodated in the semi-spherical recess 21 formed in the front end of the movable manipulation member 11.

On the other hand, a guide plate 24 is rotatably supported on the front end of the lever shaft 13 via a bearing 23. The guide plate 24 is provided on the rear face thereof with a spiral groove (spiral guide) 28 with its radius continually decreasing in the rotational direction of the drive plate 2. The ball 22 held in position by the movable manipulation member 11 engages the spiral guide 28.

As the guide plate 24 in engagement with the ball 22 is rotated under an external force in the phase-lag direction (i.e. in the direction opposite to the rotational direction of the drive plate 2) relative to the drive plate 2, the movable manipulation member 11 is moved along the radial guide 10 and spiral groove 28, thereby shifting radially inwardly. In response to this radially inward movement of the movable manipulation member 11, the camshaft 1 is rotated (that is, advance in phase) by the link action of the link arm 14 coupled to the lever 12 in the phase-lead direction relative to the drive plate 2, since the camshaft 1 is integral with the lever shaft 13, so that camshaft 1 is advanced in the phase relative to the drive plate 2.

On the other hand, contrary to the relative rotation in the phase-lag direction mentioned above, if the guide plate 24 is rotated in the phase-lead direction (rotational direction of the drive plate 2) relative to the drive plate 2 by a torque transmitted from the engaging balls 22, the movable manipulation member 11 is moved by the spiral groove 28 in the radially outward direction. As the movable manipulation member 11 is moved in the radially outward direction, the camshaft 1 is rotated in the phase-lag direction relative to the drive plate 2, so that camshaft 1 is retarded in phase relative to the drive plate 2.

That is, in the apparatus of Patent Document 1, the phase angle of the camshaft 1 is advance or retarded in phase relative to the drive plate 2 by applying a torque to the guide plate 24 so as to rotate the guide plate 24 in the phase-lead or phase-lag direction relative to the drive plate 2. This torque for causing the relative rotation of the guide plate 24 against the drive plate 2 is applied using a planet gear mechanism 25 coupled to a first and a second electromagnetic brake (26, 27), as shown below.

This planetary gear mechanism 25 comprises: a sun gear 30 integral with a braking flange 34 that is rotatably coupled to the front end of the lever shaft 13 via a bearing 29; a ring gear 31 formed on the inner surface of the recess formed at the front end of the guide plate 24; a carrier plate 32 securely fixed between the bearings 23 and 32 and to the lever shaft 13; and a plurality of planetary gears 33 rotatably supported by the carrier plate 32 to engage sun gears 30 and 31. The first and second electromagnetic brakes 26 and 27 are arranged to face the front ends of the guide plate 24 and braking flange 34, to thereby hinder the rotations of the guide plate 24 and flange 34.

Hence, the guide plate 24 is acted upon by a braking torque of the electromagnetic brake 26, and is rotated in the phase-lag direction relative to the drive plate 2. On the other hand, the sun gear 30 is acted upon by a braking torque of the electromagnetic brake 27, and is rotated in the phase-lag direction relative to the carrier plate 32. In this case, the ring gear 31 is accelerated by the spinning of the planetary gear 33. Consequently, as the sun gear 30 is braked by the electromagnetic brake 27, the guide plate 24 is acted upon by a torque that causes the guide plate 24 to rotate in the phase-lead direction relative to the drive plate 2. Thus, the phase angle of the camshaft 1 relative to the drive plate 2 is varied in either the phase-lead direction or phase-lag direction in accordance with the torque applied to the guide plate 24.

On the other hand, the valve timing regulation apparatus of Patent Document 2 has a rotational member 12 that is rotatably supported by an output shaft 22 integral with the camshaft 4 and is driven by the crankshaft. An electric motor 70 is provided to rotate the eccentric shaft 18 integral with an action shaft 72. The rotation of the eccentric shaft 18 in turn rotates an output shaft 22 via a ring gear 14 and a planetary gear 30 that rotates in the direction opposite to that of the eccentric shaft 18. Thus, by rotating the camshaft 4 relative to the rotational member 12 supported by the output shaft 22, the phase angle between them is changed to vary the valve timing.

Patent Document 1: Japanese Patent Application Laid Open 2006-77779.

Patent Document 2: Japanese Patent Application Laid Open 2004-3419.

DISCLOSURE OF THE INVENTION

Problems to be Solved by the Invention

It is noted that the apparatus of Patent Document 1 uses the planetary gear mechanism 25 for rotating the guide plate 24 relative to the drive plate 2, which includes a plurality of gears such as planetary gears 33 and ring gear 32 along with the sun gear 30. Consequently, the apparatus of Patent Document 1 suffers from a common problem that the it is costly, since the mechanism has many costly gears.

It is well known that a multiple-gear system results in gear rattle, which destroys calmness of the apparatus. This is the case with the apparatus of Patent Document 1 which uses a plurality of gears and generates a big gear rattle when the apparatus is in operation varying the valve timing. Although such noise can be reduced by improving the mechanical precision of gears and reducing backlashes of the gears, it inevitably raises manufacturing cost.

The apparatus of Patent Document 2 has a further problem in that if the electric motor 70 is turned off after phase conversion an emf will be generated in a coil 90 of the motor 70 by the action shaft 72 still in rotation, resulting in a resistive torque that acts on the rotational member 12. Therefore, in order to maintain the rotating action shaft 72 synchronized with the rotational member 12, no matter whether the phase change has been done or not, the electric motor 70 cannot be turned off. Thus, use of such electric motor is disadvantageous from the point of installation cost but also maintenance cost. In addition, an electric motor for use with an automotive variable phase controller needs to be small to save installation space. In varying the phase angle between the camshaft and crankshaft, in order to generate a large torque using a small electric motor, a speed reduction mechanism (such as a planetary gear 30) is required between them. Such mechanism, however, presents a problem that it lowers the response of the camshaft changing the phase angle relative to the crankshaft.

In view of such problems as mentioned above, the present invention provides a cost-effective and calmer rotational mechanism, suitable for automotive variable phase controller, that can provide equivalent relative rotation provided by the guide plate 24 for example.

Means for Solving the Problems

To solve the problems the present invention provides a variable phase controller for an automotive??? engine, including a drive rotor driven by a crankshaft of the engine, an intermediate rotor integral with the camshaft, and a first control rotor, the drive rotor such that the drive rotor, intermediate rotor, and first control rotor are aligned to a common rotational axis and rotatable relative to each other, and including torque means for rotating the first control rotor relative to the drive rotor and the first intermediated rotor, wherein the first intermediate rotor and the first control rotor rotated relative to each other in accordance with the direction of the relative rotation of the first control rotor to thereby change the phase angle of the camshaft relative to the drive rotor, the variable phase controller characterized in that the torque means comprises:

first guide grooves formed in the first control rotor each extending in a substantially circumferential direction with a continuously decreasing radius;

first braking means for rotating the first control rotor relative to the first intermediate rotor and drive rotor;

a second intermediate rotor integral with the camshaft and having guide slits extending in substantially radial directions, the second intermediate rotor being coaxially disposed adjacent to, and rotatable relative to, the first control rotor;

a second control rotor formed with second guide grooves each extending in the opposite direction with respect to the first guide grooves with a continuously decreasing radius, second control rotor mounted coaxial with, and rotatable relative to, the second intermediate rotor;

second braking means for rotating the second control rotor relative to the second intermediate rotor and first control rotor; and movable members adapted to engage the first guide grooves, radial guide grooves, and second guide grooves and move in the respective guide grooves in accordance with the relative rotation of the first control rotor and second control means.

(Function) Under the initial condition, the first control rotor rotates together with the first intermediate rotor integral with the camshaft and with the drive rotor driven by the crankshaft. The first control rotor is rotated by the torque means relative to the drive rotor and first intermediate rotor. In this case, the first intermediate rotor is rotated relative to the drive rotor in accord with the direction of the relative motion of the first control rotor. As a consequence, the phase angle of the first intermediate rotor (or camshaft) relative to the drive rotor (or crankshaft) is changed in the phase-lead direction (that is, the direction of the drive rotor) or phase-lag direction (direction opposite to the drive rotor), in accordance with the direction of the relative rotation of the first control rotor.

Because of the retardation in phase of the first control rotor relative to the drive rotor and first intermediate rotor under the braking action of the first braking means, the phase angle of the first intermediate rotor relative to the drive rotor is changed in either the phase-lead or phase-lag direction. On the other hand, the braking action of the second braking means results in retardation in phase (that is, relative rotation in the phase-lag direction) of the second control rotor, and of the second guide grooves formed in the rearward face thereof, relative to the first control rotor and second intermediate rotor. Then, the movable members, which are in engagement with the second guide grooves extending in one circumferential direction with its radii continuously decreasing and in engagement with the radial guide grooves of the second intermediate rotor, are moved in the respective guide grooves, thereby moving in the radial directions of the second intermediate rotor. Since the first guide grooves, configured to extend in the opposite circumferential direction with decreasing radii with respect to the second guide grooves, are acted upon by forces transmitted from the movable members moving in the radial directions, the first control rotor is rotated in the phase-lead direction relative to the second control rotor and second intermediate rotor, and at the same time rotated in the phase-lead direction relative to the drive rotor and first intermediate rotor. As a consequence, the relative phase angle of the first intermediate rotor relative to the drive rotor is changed in the opposite direction as compared with the change caused by the first braking means.

It should be appreciated that all of the first control rotor, second intermediate rotor, second control rotor, and movable members have basically simple circular workable configurations. It should be also appreciated that the movable members calmly slides in the respective guide grooves while changing the phase angle between the drive rotor and first intermediate rotor. After changing the phase angle, the first and second braking means can be turned off. No speed reduction mechanism is needed for changing the variable phase controller.

To achieve the object above, the invention provides a variable phase controller for an automotive engine, including a drive rotor driven by the crankshaft of the engine, an intermediate rotor integral with a camshaft, and a first control rotor such that the drive rotor, intermediate rotor, and first control rotor are all aligned to a common rotational axis and rotatable relative to each other, and including torque means for rotating the first control rotor relative to the drive rotor and the first intermediated rotor, with the first intermediate rotor and the first control rotor being adapted to be rotated relative to each other in accordance with the direction of the relative rotation of the first control rotor, to thereby change the phase angle of the camshaft relative to the drive rotor, the variable phase controller characterized in that the torque means comprises:

first brake means for rotating the first control rotor relative to the first intermediate rotor and drive rotor;

a first circular eccentric cam protruding from the first control rotor in the direction of the rotational axis, and having a central axis offset from the rotational axis;

a second control rotor having a second circular eccentric cam protruding in the direction of the rotational axis and having a central axis offset from the rotational axis, the second control rotor being coaxial with, and rotatable relative to, the first control rotor;

a cam guide plate having a pair of oblong circular bores each extending in the direction substantially perpendicular to the axis of the camshaft and adapted to receive therein the first circular eccentric cam and second circular eccentric cam such that the cams are freely movable in the longitudinal direction of the oblong bores, the cam guide plate unrotatably supported by the camshaft, but freely movable in the direction substantially perpendicular to the longitudinal direction of the oblong bores and the axial direction of the camshaft; and second braking means for rotating the second control rotor relative to the cam guide plate and the first control rotor, the first and second circular eccentric cams arranged such that the lines connecting the respective cam centers and the rotational axis are inclined with respect to the freely movable direction of the cam guide plate, and arranged substantially symmetric with respect to the freely movable direction.

(Function)

Under the braking action of the first braking means, the first control rotor is retarded in phase relative to the drive rotor and first intermediate rotor, and the phase angle of the first intermediate rotor is either advanced or retarded relative to the drive rotor in accordance with the direction of said relative rotation of the first control rotor.

On the other hand, the second control rotor is retarded in phase relative to the first control rotor and cam guide plate due to the braking action of the second braking means. Thus, the second control rotor is rotated in the phase-lag direction together with the second circular eccentric cam provided on the rearward face thereof. Within the oblong circular bore formed on the forward face of the cam guide plate, the second circular eccentric cam slides in the longitudinal direction against the reaction exerted by the second circular eccentric cam in motion. Hence, the second circular eccentric cam is displaced in the direction substantially perpendicular to the longitudinal direction of the recessed oblong bore and perpendicular to the axial direction of the camshaft.

The first circular eccentric cam formed on the forward face of the first control rotor is inclined with respect to the direction of displacement of the cam guide plate. Moreover, since the first and second circular eccentric cams are positioned substantially symmetric across the line of displacement, the first eccentric cam is acted upon by a reactive force exerted by the engaging oblong bore formed in the rearward face of the cam guide plate as the cam guide plate is displaced. Thus, the first circular eccentric cam is rotated in the direction opposite to the second eccentric cam, that is, in the phase-lead direction. As a consequence, the first control rotor is rotated in the phase-lead direction relative to the second control rotor and cam guide plate, and at the same time rotated in the phase-lead direction relative to the drive rotor and the first intermediate rotor. As a consequence, the relative phase angle of the first intermediate rotor relative to the drive rotor is changed in the opposite direction as compared with the change caused by the first braking means.

It should be appreciated that all of the first control rotor, cam guide plate, and second control rotor have basically simple circular workable configurations. It should be also appreciated that the drive rotor and first intermediate rotor calmly slides in the respective guide grooves while changing the phase angle between the drive rotor and first intermediate rotor. After changing the phase angle, the first and second braking means can be turned off. No speed reduction mechanism for change the phase angle is needed.

Results of the Invention

Since the inventions as defined in claims 1 and 2 utilize torque means constituted of elements that are easier to manufacture than gears and does not employ costly electric motor, a calm relative rotational mechanism for the first control rotor may be provided at low cost. In addition, electric power may be saved by turning off the braking means upon completion of a phase change. Further, quick phase angle variation may be achieved by not employing any speed reduction mechanism.

BEST MODE FOR CARRYING OUT THE INVENTION

The invention will now be described in detail by way of example with particular reference to a first and a second embodiment.

FIG. 1 is an exploded perspective view of a variable phase controller for automotive engine in accordance with a first embodiment of the invention, taken from front of the controller. FIG. 2 is an exploded perspective view of the controller, taken from rear of the variable phase controller. FIG. 3 is a front view of the controller. FIG. 4 is an axial cross sectional view taken along line A-A of FIG. 3. FIG. 5 shows radial cross section of the variable phase controller taken along line B-B of FIG. 4 (FIG. 5(*a*)), C-C (FIG. 5(*b*)), and D-D (FIG. 5(*c*)). FIG. 6 is an axial cross sectional view of the variable phase controller taken along line E-E of FIG. 3. FIG. 7 is a cross sectional view taken along line F-F of FIG. 6. FIG. 8 is a cross sectional view taken along line G-G. FIG. 9 is a cross sectional view taken along line H-H of FIG. 6. FIG. 10 is a diagram illustrating the first variable phase controller in operation. More particularly, FIG. 10(*a*) represents the initial condition of the controller prior to subjecting any phase change; FIG. 10(*b*), the controller subjected to an action for changing its phase; FIG. 10(*c*), condition of the controller subjected to a maximum phase change. FIG. 11 is an exploded perspective view of a second phase variable controller for an automotive engine according to the invention, the view taken from front thereof. FIG. 12 is an exploded perspective view of the controller taken from end thereof. FIG. 13 is a front view of the second controller. FIG. 14 is an axial cross sectional view of the second controller taken along line H-H of FIG. 13. FIG. 15 is a diagram illustrating a phase conversion member for use with the controllers. More particularly, FIG. 15(*a*) is a perspective view of the phase conversion member; and FIG. 15(*b*) is an exploded perspective view of the phase conversion member. FIG. 16 is a radial cross sectional view of the variable phase controller. More particularly, FIG. 16(*a*) is a cross sectional view taken along line I-I of FIG. 14; FIG. 16(*b*) taken along J-J of FIG. 14; and FIG. 16(*c*) taken along K-K of FIG. 14. FIG. 17 is a cross sectional view taken along line L-L of FIG. 14. FIG. 18 is a cross sectional view taken along line M-M of FIG. 14. FIG. 19 is a cross sectional view taken along line N-N of FIG. 14.

The variable phase controllers of the first and second embodiments are mounted integral with an engine. It is adapted to open/close intake valve timing/exhaust valve timing in synchronism with the crankshaft of the engine by varying the opening/closing timing of the valves in accord with such operating conditions of the engine as load and/or rpm.

Referring to FIGS. 1-10, there is shown the first embodiment of the invention. For the sake of simplicity, one end of the controller having a second electromagnetic clutch 60 will be hereinafter referred to as the forward end, while the other end connected to a camshaft 40 will be referred to as the rearward end. This apparatus has such coaxial elements as: a drive rotor 41 driven by the crankshaft (not shown) of the engine; a center shaft 42 which is fixed to a camshaft 40 to rotatably support the drive rotor 41; a first intermediate rotor 43 unrotatably mounted ahead of the drive rotor 41 on the center shaft 42 but rotatable relative to the drive rotor 41; a first control rotor 45 rotatably mounted ahead of the first intermediate rotor 43 on the center shaft 42; and a first electromagnetic clutch 44 fixed to an engine casing (not shown) for braking the first control rotor 45, all having the same rotational axis L1. The first intermediate rotor 43 serves as a guide plate 43 of the first control rotor 45, as described later.

The first control rotor 45 is provided on the rear surface thereof with a circular eccentric cam 46 that rotates eccentrically about the rotational axis L1 together with the first control rotor 45. Mounted behind the first control rotor 45 is a cam guide plate 47 that engages an oblong circular bore 54 for reciprocal movement within the bore 54 in the direction perpendicular to the rotational axis L1. The circular eccentric cam 46 engages the oblong circular bore 54.

The center shaft 42 has a bore 42*a* in which the leading end 40*a* of the camshaft 40 engages. and is unrotatably integrated to the center shaft 40. The drive rotor 41 has a sprocket 41*a* and a drive plate 41*b* each having holes 41*c* and 41*d*, respectively. The center shaft 42 is passed through these holes such that they are rotatably mounted on the respective cylindrical sections 41*c* and 42*d* of a flange 42*b* formed on the outer periphery of the center shaft 42. They are coupled together by a multiplicity of coupling pins. The drive plate 41*b* is formed with a pair of curved circumferential guide grooves 51 each having a decreasing radius about the rotational axis L1. In the first embodiment, each of the guide grooves 51 extends in the rotational direction D1 (clockwise D1 direction when viewed from front).

The first intermediate rotor 43 has a cylindrical form. Its bottom section 43*a* has a square hole 43*b* and a pair of radially extending oblong grooves (escape grooves) 49 to allow slide pins 50 (described in more detail later) to move therein without touching it, and guide pins 43*c*-43*f* having the same outer diameter. The first intermediate rotor 43 is unrotatably mounted on the center shaft 42 with the flat engaging face 42*e* of the center shaft 42 fitted in the square hole 43*b* of the first intermediate rotor 43. It is noted that the line connecting the guide pins 43*c* and 43*d* (or 43*e* and 43*f*) are aligned parallel to the longitudinal direction of the radially extending grooves 49.

The first control rotor 45, circular eccentric cam 46, and cam guide plate 47 are arranged inside the cylindrical section 43*k* of the first intermediate rotor 43. The first control rotor 45 has on the forward face thereof a round through-hole 45*a* centered at the rotational axis L1 for passing therethrough the cylindrical leading section 42*f* of the center shaft 42, and has on the rearward face thereof a circular eccentric hole 45*b* with its central axis L2 offset from the rotational axis L1 by a distance d1. The circular eccentric cam 46 has a forward circular eccentric cam 52 that has a central axis L2 and engages the circular eccentric bore 45*b*, and a rearward circular eccentric cam 53 that has a central axis L3 and is offset from the rotational axis L1 by a distance d2 larger than d1. These cams 52 and 53 are coaxial and integrated together to have a common round through-hole 46*a* centered at the rotational axis L1. The circular eccentric cam 46 is rotatably mounted on the cylindrical section 42*f* formed at the leading end of the center shaft 42 that passes through the round through-hole 46*a*. The first control rotor 45 has a disk shape having substantially the same diameter as the inner diameter of the stepped face 43*l* formed at the leading end of the cylindrical section 43*k* of the first intermediate rotor. The first control rotor 45 is disposed inside the stepped face 43*l*, with its outer circumference 45*c* in substantial contact with the stepped face 43*l*. It is noted that the circumferential configurations of the eccentric cams 52 and 53 need not be circular as in the embodiments shown herein, and can be of any other configuration.

The cam guide plate 47 is provided with a pair of engagement bores 47*a* and an oblong bore 54 for slidably accepting therein the rearward circular eccentric cam 53. The cam guide plate 47 is provided with a multiplicity of slide pins (slidable members) 50 protruding rearward from the respective engagement bores 47*a*. Each of the slide pins 50 consists of a diametrically small hollow shaft 50*a* inserted in a diametrically large hollow shaft 50*b*. One end of the diametrically small hollow shaft 50*a* engages one of the engagement bores 47*a*. The diametrically large hollow shaft 50*b* is inserted in one of the radially extending grooves 49 of the first intermediate rotor 43 without contacting the radially extending grooves 49. The other end of the diametrically small hollow shaft 50*a* movably engages one of the substantially circumferential guide grooves 51 formed in the drive plate 41*b*.

The oblong circular bore 54 extends in the direction substantially perpendicular to line connecting the centers of the pair of the engagement bores 47*a*. This direction matches longitudinal direction of the radially extending grooves 49. The circular eccentric cam 53 slidably moves back and forth within the oblong circular bore 54. Formed on the opposite sides of the cam guide plate 47 are flat surfaces 47*b* and 47*c* which are adapted to abut against the guide pins 43*c* and 43*d* and guide pins 43*e* and 43*f*.

Arranged ahead of the first control rotor 45 is a first electromagnetic clutch 44 provided on the rearward face thereof with a frictional member 55. When the coil 44*a* of the first electromagnetic clutch 44 is turned on, the first electromagnetic clutch 44 will attract the contact face 45*d* of the first control rotor 45, bringing the contact face 45*d* into slidable contact with the frictional member 55, thereby braking the first control rotor 45.

Arranged ahead of the first control rotor 45 are, in the order mentioned, a second intermediate rotor 56, second control rotor 57, disc spring 58, spring holder 59 and second electromagnetic clutch 60.

The first control rotor 45 is provided on the forward face thereof with a pair of curved grooves (referred to as first guide grooves 61) in the form of circumferential grooves (FIG. 9) extending in counterclockwise D2 direction (as viewed from front), that is, in the direction opposite to the rotational direction of the drive rotor 41, and having continuously decreasing radii about the rotational axis L1. The second control rotor 57 is provided on the rearward face thereof with a pair of curved grooves (referred to as second guide grooves 62) in the form of circumferential grooves (FIG. 7) extending in the clockwise D2 direction and having continuously decreasing radii about the rotational axis L1. The second intermediate rotor 56 is provided on the opposite sides of a central square hole 56*a* with radial guide grooves 63.

The second intermediate rotor 56 is unrotatably mounted on the center shaft 42 by fitting the second flat engagement faces 42*g* of the center shaft 42 in the square hole 56*a* of the second intermediate rotor 56. The second control rotor 57 is rotatably supported by the center shaft 42 by fitting the small cylindrical section 42*h* formed at the leading end of the center shaft 42 in the circular bore 57*a* formed at the center of the second control rotor 57. A pair of slide pins 64 movably engage the guide grooves 61-63. Like the slide pins 50, each slide pin 64 is formed of a diametrically small shaft 64*a* inserted into a diametrically large hollow shaft 64*b*. The opposite ends of the diametrically small shafts 64*a* movably engage the first and second guide grooves 61 and 62, while the diametrically large hollow shafts 64*b* movably engage the radial guides 63.

It is noted that by configuring each slide pin 64 in the form of a flange by making the diametrically large hollow shaft 64*b* larger in diameter than the diametrically small shaft 64*a*, the forward and rearward faces of the diametrically large hollow shaft 64*b* may be disposed between the forward face of the first control rotor 45 and the rearward face of the second control rotor 57. Then, the slide pins 64 can be maintained in position without being inclined in the axial direction, thereby preventing the pins from falling during their movements in the respective guide grooves and preventing friction with, and wear of, the guide grooves 61-63.

The disc spring 58 is placed in the recessed circular bore 57*a* formed in the forward face of the second control rotor 57. A spring holder 59 is arranged ahead of the stepped cylindrical section 42*i* of the center shaft 42. A bolt 65 is passed through the central holes of all the constituent members between the spring holder 59 and the drive plate 41*b* inclusive and securely screwed into the tapped hole 40*b* of the camshaft 40. All the members between the second control rotor 57 and drive plate 41*b* inclusive are held in position by securely fixing the spring holder 59 to the stepped cylindrical section 42*i*. The second electromagnetic clutch 60 is fixed to the engine casing (not shown) to face the second control rotor 57. When the coil 60*a* of the second electromagnetic clutch 60 is turned on to attract the contact face 57*b* of the second control rotor 57, the contact face 57*b* slidably abuts against the friction member 66, thereby braking the second control rotor 57.

Incidentally, to put a brake on the second control rotor 57, the contact face 57*b* may protrude forwardly of the contact face 45*d* of the first control rotor 45, as described in detail later in connection with the second embodiment. However, the contact face 57*b* is preferably arranged to lie in the same plane as the 45*d* as shown in the first embodiment (FIG. 6). When the second control rotor 57 is arranged inside a coil 44*a*, it can be magnetized by the magnetic field of the first electromagnetic clutch 44, which may cause instability of the first electromagnetic clutch 44 in operation. Therefore, by arranging the contact face 45*d* flush with the contact face 57*b*, the second control rotor 57 can be set at a distance sufficiently far from the influential magnetic field of the 44 to prevent such instability.

The movable members presently in the form of slide pins 64 can be bearings or balls for example so that they can roll in the grooves while they are displaced in the guide grooves 61-63. Then, the slide pins are subjected to less friction and can move easily in the grooves, thereby reducing the power consumption by the respective electromagnetic clutches. On the other hand, if the slide pins 64 are replaced by balls, the first and second guide grooves 62 and 62, respectively, are preferably V- or R-shaped in axial cross section. When the balls are displaced, they are subjected to thrust forces acting in the rotational axis L1, but the thrust forces can be annihilated by the disc spring 58. It is noted that balls can reduce the manufacturing cost than thrust pins.

The second intermediate rotor 56 is preferably made of a non-magnetic material. A non-magnetic second intermediate rotor 56 can circumvent a trouble that the magnetic field generated to attract one of the control rotors 45 and 57 for braking action is inadvertently transmitted to other control rotor via the second intermediate rotor 56 and attracts the other control rotor.

Referring to FIG. 5 and FIGS. 7-10, steps of varying phase angle of the camshaft 40 relative to the drive rotor 41 will now be described. Under the initial condition where no phase angle difference exists between them, as the drive rotor 41 is rotated by the crankshaft (not shown) in the clockwise D1 direction as viewed from front, the first intermediate rotor 43, first control rotor 45, second intermediate rotor 56, and second control rotor 57 are rotated together in the clockwise D1 direction.

To increase, or advance, the phase angle of the camshaft 40 relative to the drive rotor 41, that is, to rotate the camshaft 40 in the clockwise D1 direction (as viewed from front), the second control rotor 57 is braked. If the second control rotor 57 is braked by the second electromagnetic clutch 60, the second control rotor 57 is retarded in phase relative to the second intermediate rotor 56 and first control rotor 45, rotating in the phase-lag direction (i.e. counterclockwise D2 direction as viewed from front). In this case, the second guide grooves 62 are rotated in the phase-lag direction (direction D2) relative to the second intermediate rotor 56 and first control rotor 45 as shown in FIG. 10. Then, the slide pins 64 are displaced radially inwardly (D3 direction in FIG. 10) with respect to the second intermediate rotor 56 as they are moved in the first guide grooves 61 and radial guide grooves 63 of the second intermediate rotor 56. As the first guide grooves 61 are subjected to forces transmitted from the slide pins 64 moving radially inwardly, the first control rotor 45 is rotated in the phase-lead direction (D1 direction) relative to the second intermediate rotor 56 and second control rotor 57.

At the same time, the first control rotor 45 shown in FIG. 5 is rotated in the phase-lead direction (D1 direction) relative to the first intermediate rotor 43 and drive rotor 41, while the forward circular eccentric cam 52 is eccentrically rotated in the clockwise D1 direction about the rotational axis L1. In this instance, the rearward circular eccentric cam 53 slidably moves back and forth in the oblong circular bore 54, that is, reciprocates in the longitudinal direction of the oblong circular bore 54, acting a radial force on the cam guide plate 47 in the longitudinal direction of the radial grooves 49. The flat faces 47*b* and 47*c* of the cam guide plate 47 in sliding contact with the respective guide pins 43*c*-43*f* cause slide members (slide pins) 50 to move downward in the radial grooves 49 of the first intermediate rotor 43.

The relative rotation of the cam guide plate 47 relative to the first intermediate rotor 43 is prohibited by the guide pins 43*c*-43*f*. Consequently, as the slide pins 50 move downward while they are displaced in the first guide grooves 51 in D1 direction, the cam guide plate 47 is rotated in D1 direction relative to the drive rotor 41 by the force transmitted from the first guide grooves 51 whose radii decrease in D1 direction, the first intermediate rotor 43 is displaced in D1 direction together with the cam guide plate 47. As a result, the phase angle of the drive rotor 41 driven by the crankshaft relative to the camshaft 40 integral with the first intermediate rotor 43 is changed to phase-lead direction (D1 direction).

On the other hand, to retard the advanced phase angle of the camshaft 40 (that is, rotate the camshaft 40 in D2 direction) relative to the drive rotor 41, the first electromagnetic clutch 44 is activated to brake the first control rotor 45. Being braked, the first control rotor 45 and the rearward circular eccentric cam 53 are rotated in the counterclockwise D2 direction relative to the drive rotor 41 and first intermediate rotor 43. Then, the cam guide plate 47 is caused to move upward in the radial guides 49 by the rearward circular eccentric cam 53 moving in the oblong circular bore 54, in contrast to the case where the cam guide plate 47 is acted upon by a force of the second electromagnetic clutch 60.

As the slide pins 50 slide upward and move in D2 direction in the guide grooves 51, the first intermediate rotor 43 also moves in D2 direction together with the cam guide plate 47 guided by the guide grooves 51. As a result, the phase angle of the camshaft 40 relative to the drive rotor 41 driven by the crankshaft is retarded in the phase-lag direction (D2 direction).

It is noted that when the first control rotor 45 rotates in the counterclockwise D2 direction relative to the second intermediate rotor 56 and second control rotor 57, the slide pins 64 move radially outwardly in the first guide grooves 61 as well as in the radial guides 63. Then, the second guide grooves 62 are acted upon by forces transmitted from the slide pins 64. This in turn causes the second control rotor 57 to rotate in the clockwise D1 direction relative to the second intermediate rotor 56 and second control rotor 57. The phase angle of the camshaft 40 relative to the drive rotor 41 once retarded in the phase-lag direction (D2 direction) can be advanced again in the phase-lead direction (D1 direction) by braking the retarded second control rotor 57 by the second electromagnetic clutch 60.

Referring to FIG. 11-19, there is shown the second embodiment of the invention. For ease of description, the end of the apparatus facing the second electromagnetic clutch 84 (described in detail later) will be referred to as the forward end. The apparatus in accordance with the second embodiment includes such elements coaxially aligned on the axis L1 as: a center shaft 73 rotatably supporting a drive rotor 71 rotated by a torque transmitted from the crankshaft (not shown) of the engine; a first intermediate rotor 74 unrotatably fixed ahead of the drive rotor 71 to the center shaft 73; and a first control rotor 75 which is rotatably supported by the center shaft 73 at the forward end thereof and subjected to braking action by an electromagnetic clutch 44.

The forward end 40*a* of the camshaft 40 is securely fixed in a circular bore 73*a* of the center shaft 73. A sprocket 71*a* and a drive plate 71*b* constituting the drive rotor 71 are rotatably mounted on the cylindrical sections 73*c* and 73*d*, respectively, formed ahead and rear of the flange 73*b* on the outer circumference of the center shaft 73 passing through the central circular bores 71*c* and 71*d* of the sprocket 71*a* and drive plate 71*b*, respectively, which are coupled together by a multiplicity of coupling pins 48.

There are formed in the sprocket 71*b* a pair of first guide grooves 71*e* in the form of circumferential grooves extending in the counterclockwise D2 direction and having a continuously decreasing radius. The first intermediate rotor 74, which is disc shaped, has an axial square through-hole 74*a*, a pair of inclined radial guide grooves 74*b* (simply referred to as inclined guide grooves) each extending from an upper right position to a lower left position as viewed from front, and escape grooves 74*c* each running in parallel to the respective inclined guide grooves 74*b*. The inclined guide grooves 74*b* are inclined through an angle of δ in the phase-lead direction (clockwise D1 direction) with respect to the vertical axis L7 passing through the rotational axis L1. The first intermediate rotor 74 is unrotatably fixed to the flat engagement face 73*e* of the center shaft 73 passing through, and engaging, the square hole 74*a* of the first intermediate rotor 74.

The first control rotor 75 is formed with a circular through-hole 75*a* and a pair of second guide grooves 75*b* in the form of circumferential grooves extending in the clockwise D1 direction and having a continuously decreasing radii. The first control rotor 75 is rotatably supported by the cylindrical section 73*f* of the center shaft 73 passing through the circular hole 75*a* of the first control rotor 75.

An electromagnetic clutch 44 is fixed to the engine casing (not shown) to face the first control rotor 75. When the coil 44*a* is supplied with electric current, the electromagnetic clutch 44 attracts the contact face 75*g* of the first control rotor 75 to cause it to slidably abut against the friction member 55 to brake the first control rotor 75. Phase angle conversion members 76 as shown in FIG. 15 are in engagement with the first guide grooves 71*e*, inclined guide grooves 74*b*, and second guide grooves 75*b*. Each of the phase angle conversion members 76 consists of a block section 77, first slide member 78, and second slide member 79. The block sections 77 is formed to extend along the corresponding curving second guide groove 75*b*. The block section 77 has a convex face 77*a* of the same radius of curvature as the radially outer inner-walls 75*c* of the second guide grooves 75*b* and a concave face 77*b* of the same radius of curvature as the radially inner-walls 75*d* of the second guide grooves 75*b*, so that the block sections 77 are freely movable in the second guide grooves 75*b*.

As shown in FIG. 15, the first slide member 78 has a coupling shaft 78*a* which is supportively fitted in the circular hole 77*c* of the block section 77, and a slide shaft 78*b* which is adapted to movably engage the associated inclined groove 74*b*. The second slide member 79 has a coupling shaft 79*a*, which is supportively fitted in the circular hole 77*d* of the associated block section 77, and a slide shaft 79*b*, which is adapted to movably engage the associated first guide groove 71*e*. The coupling shaft 79*a* has an outer diameter smaller than the width of the escape groove 74*c*, so that it can penetrate the corresponding escape groove 74*c* without touching it.

The slide shafts 78*b* and 79*b* may be securely fixed in the respective circular holes 77*c* and 77*d* together with the coupling shafts 78*a* and 79*a* such that they can slide in the respective guide grooves 74*b* and 71*e*. Preferably, however, the slide shafts 78*b* and 79*b* are rotatable relative to the respective coupling shafts 78*b* and 79*b*, so that they can rotatably move in the guide grooves 74*b* and 71*e*. Then, the slide shafts 78*b* and 79*b* can move in the guide grooves with less friction, thereby reducing wear of the grooves.

Arranged ahead of the first control rotor 75 are, in the order mentioned, a cam guide plate 80, second control rotor 81, disc spring 82, spring holder 83, and the second electromagnetic clutch 84.

The first control rotor 75 has at the center thereof a circular through-hole 75*a* for engagement with the circular hole 73*f*. Thus, the first control rotor 75 is rotatably supported by the center shaft 73. The first control rotor 75 has a circular bore 75*a* and a first circular eccentric cam 85 formed around the circular bore 75*a*. The first circular eccentric cam 85 forwardly protrudes, along the rotational axis L1, from the bottom section 75*f* of the forward recessed circular bore 75*e* and has a central axis L4 offset from the rotational axis L1 by a distance S1. A second control rotor 81 has a circular through-hole 81*a* for rotational engagement with the circular cylindrical section 73*h* of the center shaft 73. The second control rotor 81 has a second circular eccentric cam 86 formed around the circular bore 81*a*. The second circular eccentric cam 86 extends forwardly along the rotational axis L1 and has a central axis L5 offset from the rotational axis L1 by a substantial distance S1.

On the other hand, the cam guide plate 80 has a rearward and a forward recessed oblong circular bores 80*a* and 80*b*, respectively, each slidably receiving therein a first and a second circular eccentric cams 85 and 86, respectively, and an axial central oblong square through-hole 80*c* that extends in the direction substantially perpendicular to the longitudinal direction of the recessed circular oblong bores 80*a* and 80*b*.

The cam guide plate 80 is unrotatably mounted on the center shaft 73 by fitting the second flat engagement face 73*g* in the square hole 80*c* of the cam guide plate 80, but is movable on the flat face 73*g*1 of the second flat engagement face in the longitudinal direction of the square hole 80*c*. The disc spring 82 is disposed in the forward recessed circular bore 81*b* of the second control rotor 81, while the spring holder 83 is disposed on the forward stepped cylindrical section 73*i* A bolt 65 passing through the central holes of the elements lying between the spring holder 83 and drive plate 71*b* inclusive is securely fixed in the tapped hole 40*b* of the camshaft 40, thereby holding the elements in position. The second electromagnetic clutch 84 is securely fixed to the engine casing (not shown) to face the second control rotor 81. As the second electromagnetic clutch 84 is energized, the contact face 81*c* of the second control rotor 81 is attracted towards the friction member 84*a* until it slidably abuts against the friction member 84*a* so as to brake the second control rotor 81.

It is noted that under the initial condition free of any phase change, the cam guide plate 80 is located at the far right end inside the recessed circular bore 75*e*; the first circular eccentric cam 85 is arranged such that the line L8 connecting the central axis L4 and the rotational axis L1 is inclined in the counterclockwise D2 direction relative to the horizontal axis L6 through a substantial angle of θ as shown in FIG. 17; and the second circular eccentric cam 86 is arranged such that the line L9 connecting the center axis L5 and the rotational axis L1 is inclined in the clockwise D1 direction relative to the horizontal axis L6 through a substantial angle of θ, as shown in FIG. 19.

When the first and second control rotors 75 and 81, respectively, are rotated relative to the cam guide plate 80, the first and second circular eccentric cams 85 and 86, respectively, in engagement with the respective recessed oblong circular bores 80*a* and 80*b* are slidably moved back and forth in the respective recessed oblong circular bores 80*a* and 80*b*.

It is noted that in the second embodiment the contact face 81*c* is arranged to protrude in the forward direction than the contact face 75*g*. The second control rotor 81 can be braked in this arrangement. However, the contact face 81*c* is preferably flush with the contact face 75*g* so that the second control rotor 81 will not be magnetized by the energized first electromagnetic clutch 44.

The cam guide plate 80 is preferably made of a non-magnetic material. If the cam guide plate 80 is made of a non-magnetic material, it is possible to circumvent the problem that the magnetic field generated to brake one of the control rotors 75 and 81 is inadvertently transmitted to the other one and attracts it.

Phase varying operation of the second embodiment will now be described below. In the second embodiment, the first intermediate rotor 74 integral with the camshaft 40 is set in accordance with the retardation mode in which first intermediate rotor 74 is initially retarded in phase angle (or rotated in the counterclockwise D2 direction) relative to the drive rotor 71 in rotation in the clockwise D1 direction.

Under such initial condition, the first control rotor 75 rotates in D1 direction together with the drive rotor 41 until it is braked by the first electromagnetic clutch 44. If the first control rotor 75 is braked, it is rotated in the counterclockwise D2 direction relative to the drive rotor 71 and escape groove 74. Then, the block sections 77 are displaced in the clockwise D1 direction in the second guide grooves 75*b* in the form of circumferential grooves extending about the center axis L1 with its radius continuously decreasing in the clockwise D1 direction, thereby causing the entire phase angle conversion members 76 to be moved in the radially inward direction D3 via the block sections 77 (FIG. 16).

In this case, the slide shafts 78*b* in engagement with the inclined guide grooves 74*b* move in the respective inclined guide grooves 74*b* in the substantially radially inward direction D4 (in the inclined directions of the grooves), while the slide shafts 79*b* in engagement with the first guide grooves 71*e* move in the counterclockwise D2 direction. Then, since the inclined guide grooves 74*b* are subjected to the forces transmitted from the respective first slide shaft 78*b* during the move, the first intermediate rotor 74 is rotated in the phase-lag direction relative to the drive rotor 71 rotating in the clockwise D1 direction in accordance with the displacement of the slide shafts 79*b* in the first guide grooves 71*e*. As a consequence, the phase angle of the camshaft 40 integral with the first intermediate rotor 74 is changed in the phase-lag direction, i.e. rotated in D2 direction, relative to the drive rotor 71 rotated by the crankshaft.

On the other hand, under the initial condition free of any change in phase, the cam guide plate 80 and the second control rotor 81 are in rotation in the clockwise D1 direction together with the first control rotor 75. As the first electromagnetic clutch 44 is energized, the first circular eccentric cam 85 is rotated about the rotational axis L1 from the condition as shown in FIG. 17 in the counterclockwise D2 direction until the central axis L4 of the cam 85 is rotated through a maximum angle of about 180−θ degrees with respect to the horizontal axis L6. In this instance, the first circular eccentric cam 85 reciprocally moves in the recessed oblong circular bores 80*a* and 80*b*, apply a force to the cam guide plate 80 in the direction perpendicular to the longitudinal directions of the oblong bores 80*a* and 80*b*. Then, because of the engagement of the square hole 80*c* with the flat engagement section 73*g*1, the cam guide plate 80 moves in the recessed circular bore 75*e* towards the left end thereof (in D8 direction) (FIG. 18). Similarly, under the action of the oblong circular bore 80*b* of the cam guide plate 80 in motion, the second circular eccentric cam 86 is rotated in the clockwise D1 direction, opposite to the direction of the first circular eccentric cam 85 (FIG. 19). As a consequence, the second control rotor 81 integral with the second circular eccentric cam 86 is rotated from the condition as shown in FIG. 19 in the clockwise D1 direction relative to the first control rotor 75 until the central axis L5 of the cam is inclined from the horizontal axis L6 through an angle of about 180−θ degrees in the clockwise D1 direction.

On the other hand, to rotate the camshaft 40 that has rotated in the counterclockwise D2 direction, back to an angularly advanced position in the phase-lead direction (clockwise D1 direction), the second electromagnetic clutch 84 is energized to brake the second control rotor 81. Then, the second circular eccentric cam 86 is rotated in the counterclockwise D2 direction relative to the first control rotor 75 while sliding up and down in the oblong circular bore 80*b*. This causes the cam guide plate 80 to be moved towards the right end of the recessed circular bore 75*e* (in the direction opposite to D8).

Under the force transmitted from the oblong circular bore 80*a* in sliding contact with the first circular eccentric cam 85, the first control rotor 75 is rotated in the clockwise D1 direction, that is, in the opposite direction with respect to the second control rotor 86, so that the first control rotor 75 is rotated in the clockwise D1 direction relative to the second control rotor 81. At the same time, the first control rotor 75 is also rotated in the clockwise D1 direction relative to the drive rotor 71, thereby causing the phase angle conversion member 76 to move radially outward direction, that is, in the opposite direction of the phase angle conversion member 76 moving under the action of the first electromagnetic clutch 44.

Then, the slide shafts 78*b* are displaced in the respective grooves 74*b* in substantially radially outward directions (opposite to D4), causing the slide shafts 79*b* to move in the first guide grooves 71*e* in the clockwise D1 direction. Since the inclined guide grooves 74*b* are subjected to the actions of the slide shafts 78*b*, the first intermediate rotor 74 is rotated in the phase-lead direction (D1 direction) relative to the drive rotor 71. As a consequence, the phase angle of the camshaft 40 integral with the first intermediate rotor 74 is advanced relative to the drive rotor 71 in the phase-lead (clockwise D1) direction.

It is noted that although the first control rotor (45 and 75) and the second control rotor (57 and 81) in the embodiments 1 and 2, respectively, are braked by the electromagnetic clutches (44, 60, and 84), the electromagnetic clutches many be replaced by hydraulic clutches to provide necessary braking actions on the respective control rotors.

BRIEF DESCRIPTION OF THE DRAWINGS

FIG. 5(*b*) shows a rearward vertical cross section of the intermediate rotor and the cam guide plate, taken along line C-C of FIG. 4; and FIG. 5(*c*) shows a vertical cross section of the drive rotor taken along line D-D of FIG. 4.

FIG. 10(*b*), the controller in action to change the phase of the apparatus. FIG. 10(*c*), condition of the controller subjected to a maximum phase change.

FIG. 16(*b*), taken along J-J of FIG. 14; and FIG. 16(*c*), taken along K-K of FIG. 14.

BRIEF DESCRIPTION OF SYMBOLS

Figure 1:
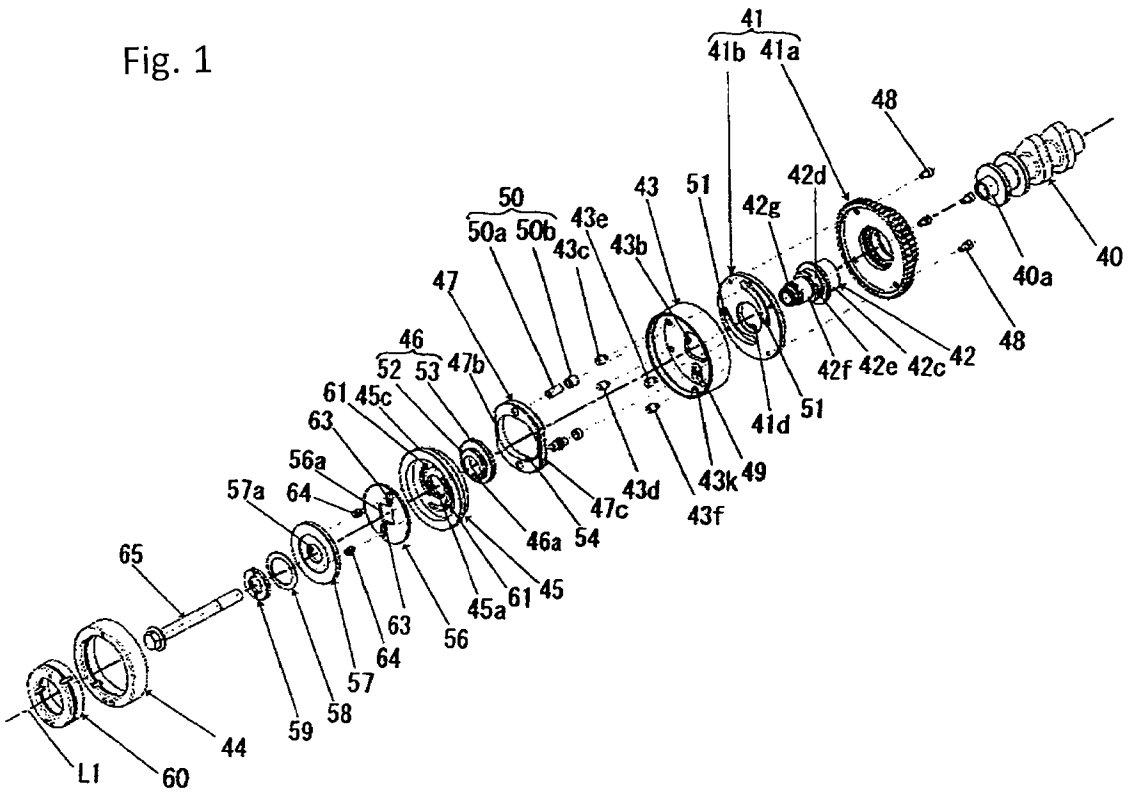
FIG. 1 is an exploded perspective view of a variable phase controller for automotive engine according to the first embodiment of the invention, the view taken from front.
Figure 2:
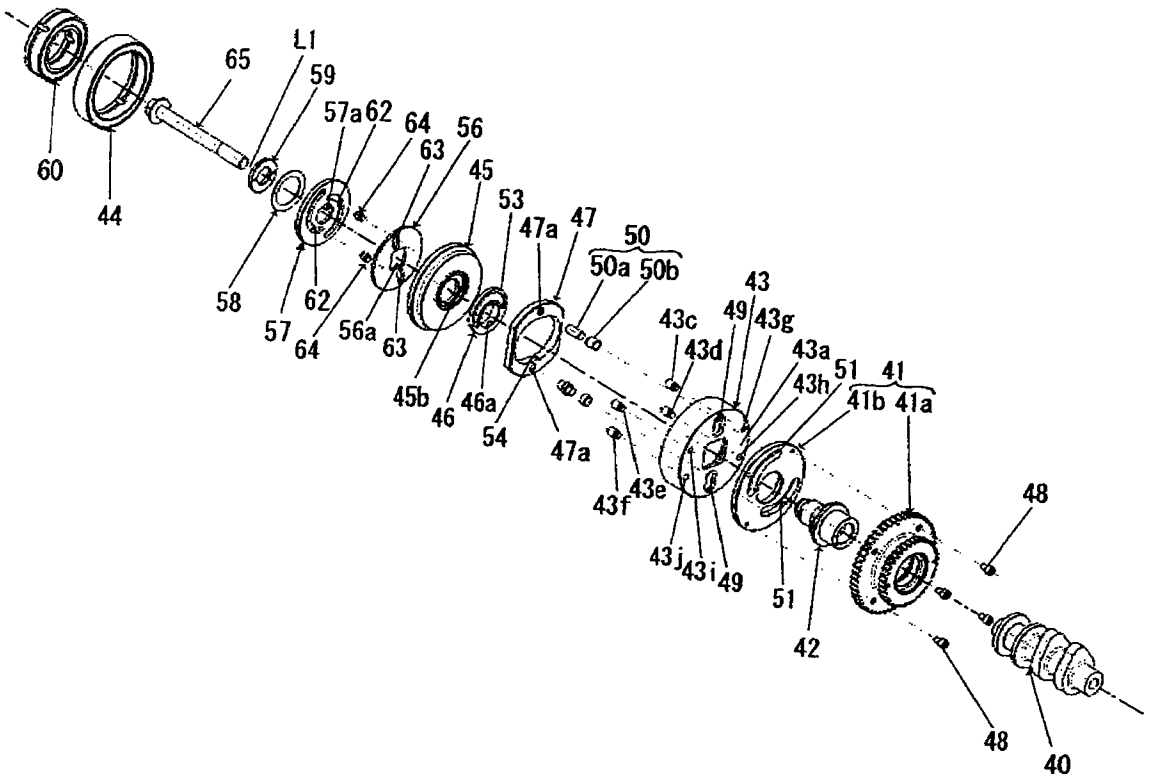
FIG. 2 is an exploded perspective view of the controller, taken from rear.
Figure 3:
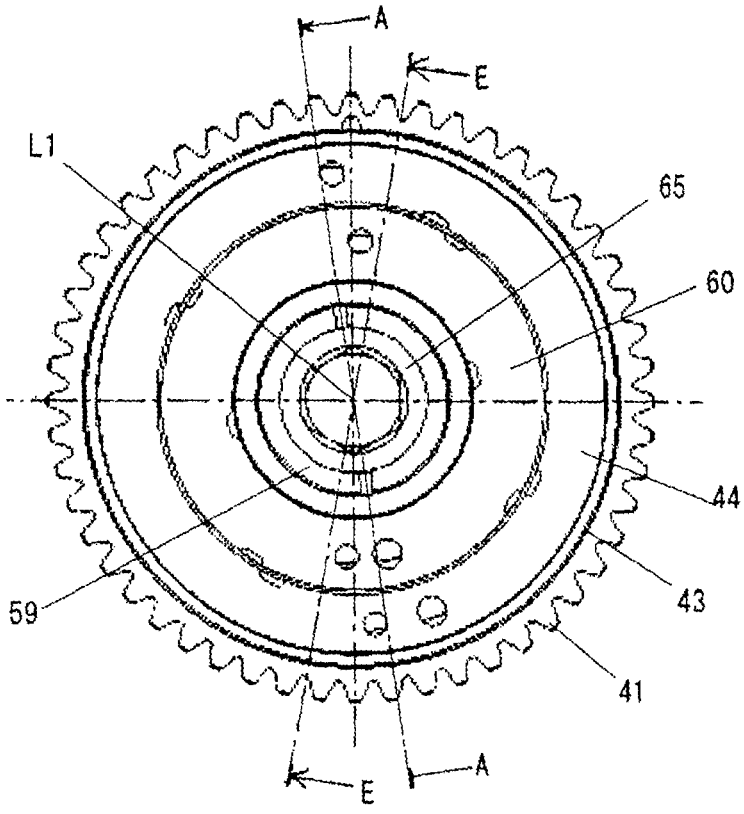
FIG. 3 is a front view of the controller.
Figure 4:
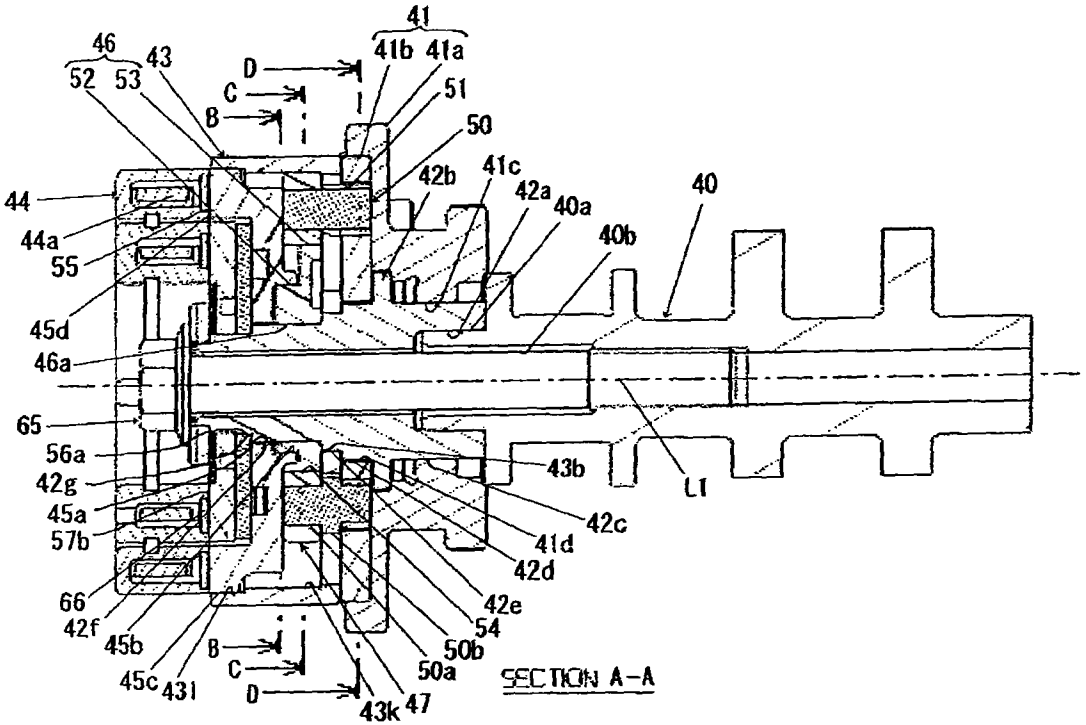
FIG. 4 is an axial cross sectional view taken along line A-A of FIG. 3.
Figure 5:
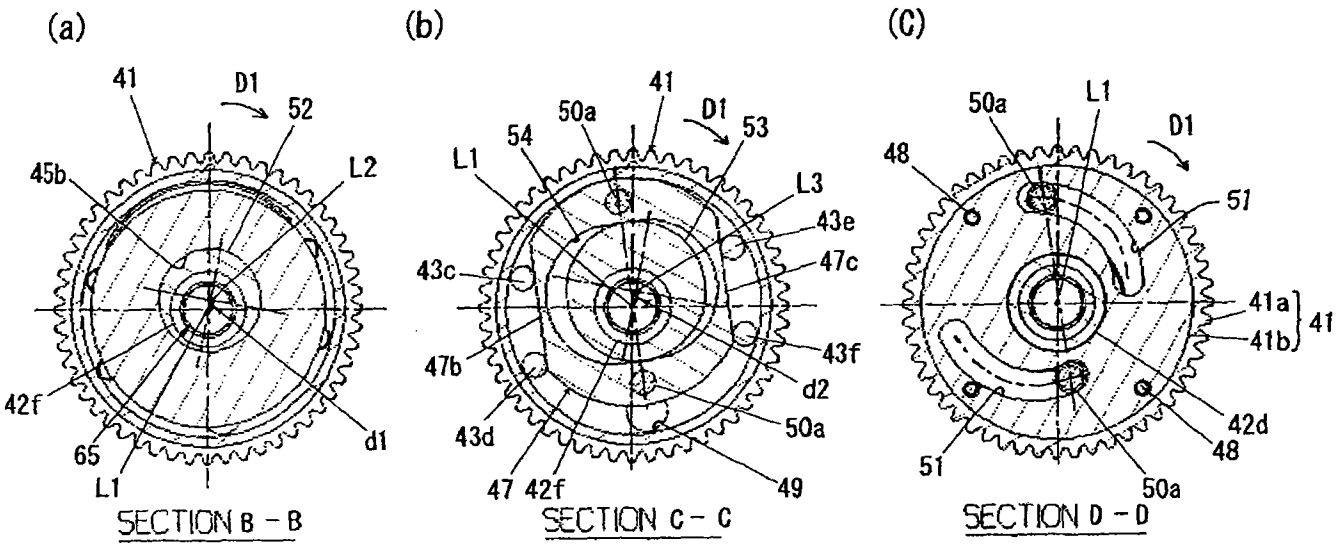
FIG. 5 shows radial cross sections of the variable phase controller. More particularly, FIG. 5(*a*) shows a rearward radial cross section of the first control rotor of the variable phase controller, taken along line B-B of FIG. 4.
Figure 6:
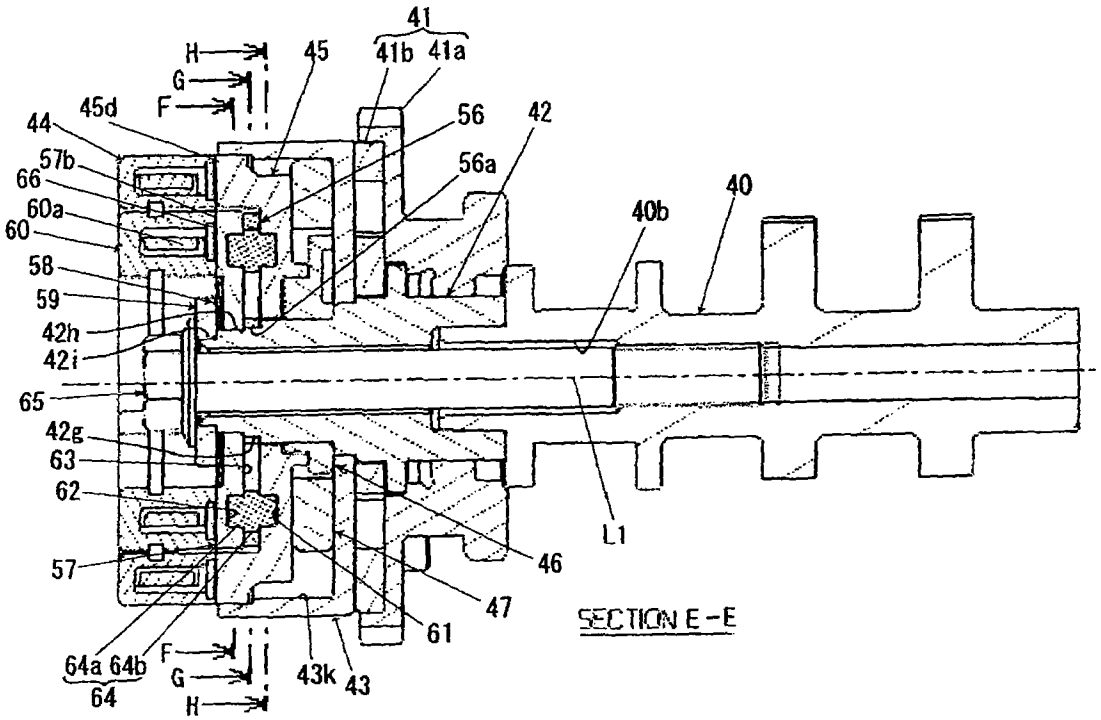
FIG. 6 is an axial cross sectional view of the controller taken along line E-E of FIG. 3.
Figure 7:
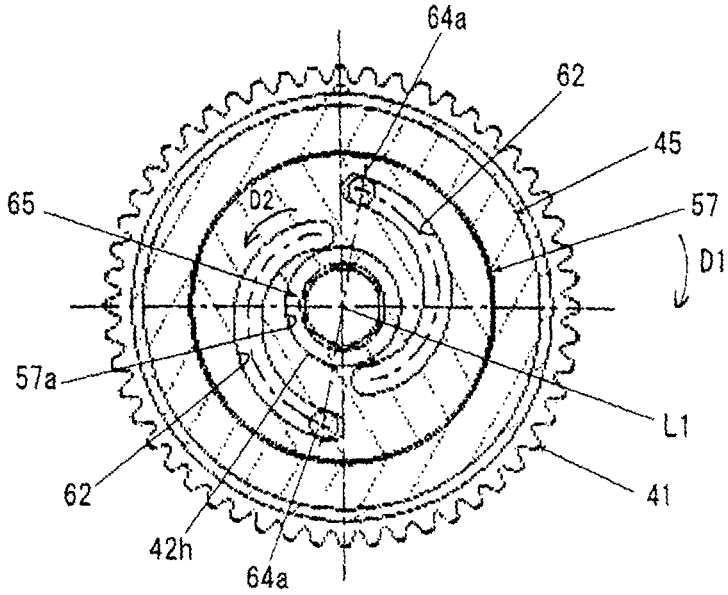
FIG. 7 is a cross sectional view of the second control rotor taken along line F-F of FIG. 6.
Figure 8:
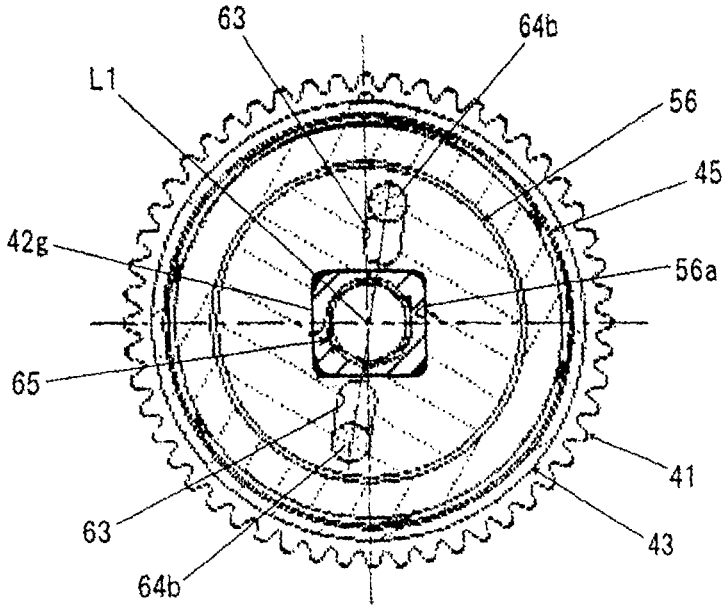
FIG. 8 is a cross sectional view of the second intermediate rotor taken along line G-G of FIG. 6.
Figure 9:
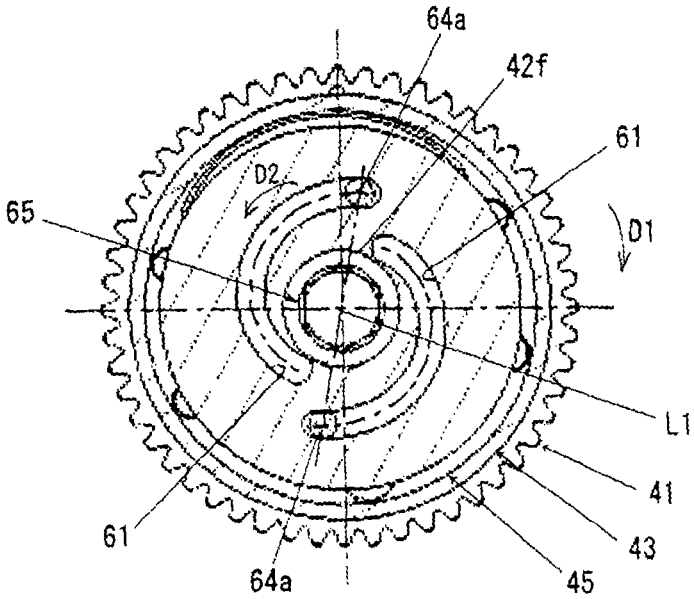
FIG. 9 is a forward cross sectional view of the first control rotor taken along line H-H of FIG. 6.
Figure 10:
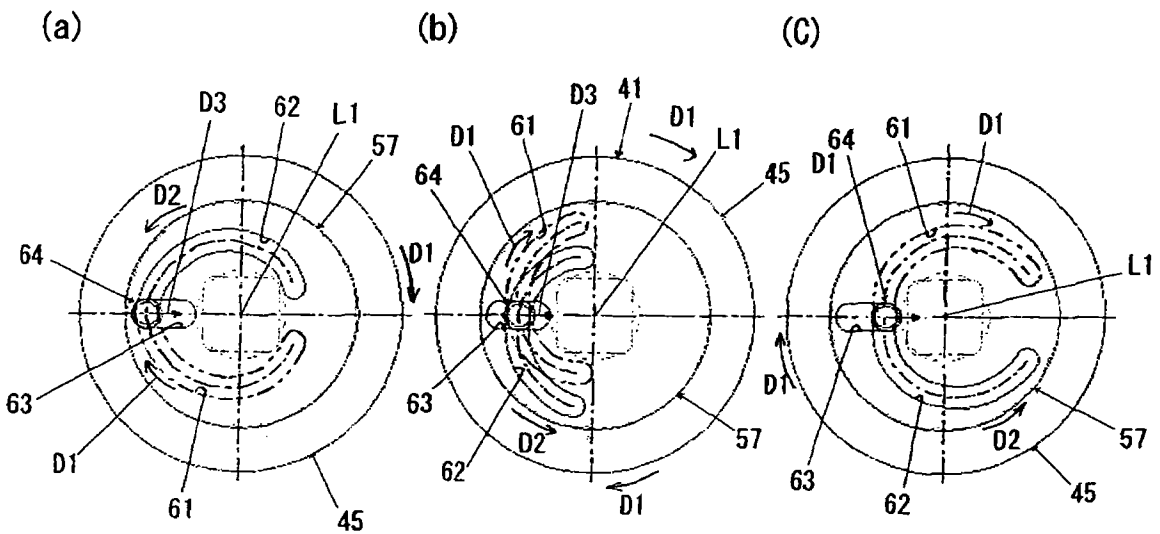
FIG. 10 is a diagram illustrating the first variable phase controller in operation. More particularly, FIG. 10(*a*) represents the initial condition of the controller prior to subjecting any phase change.
Figure 11:
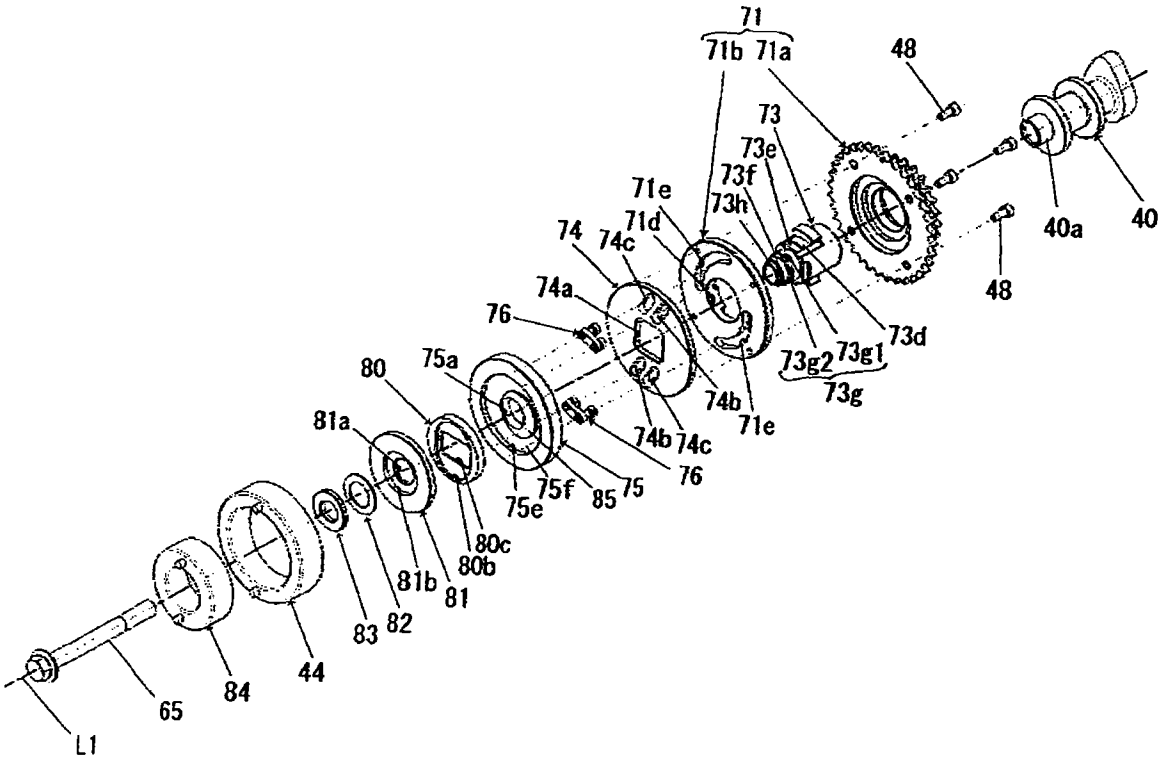
FIG. 11 is an exploded perspective view of the second variable phase controller for an automotive engine of the invention, the view taken from front.
Figure 12:
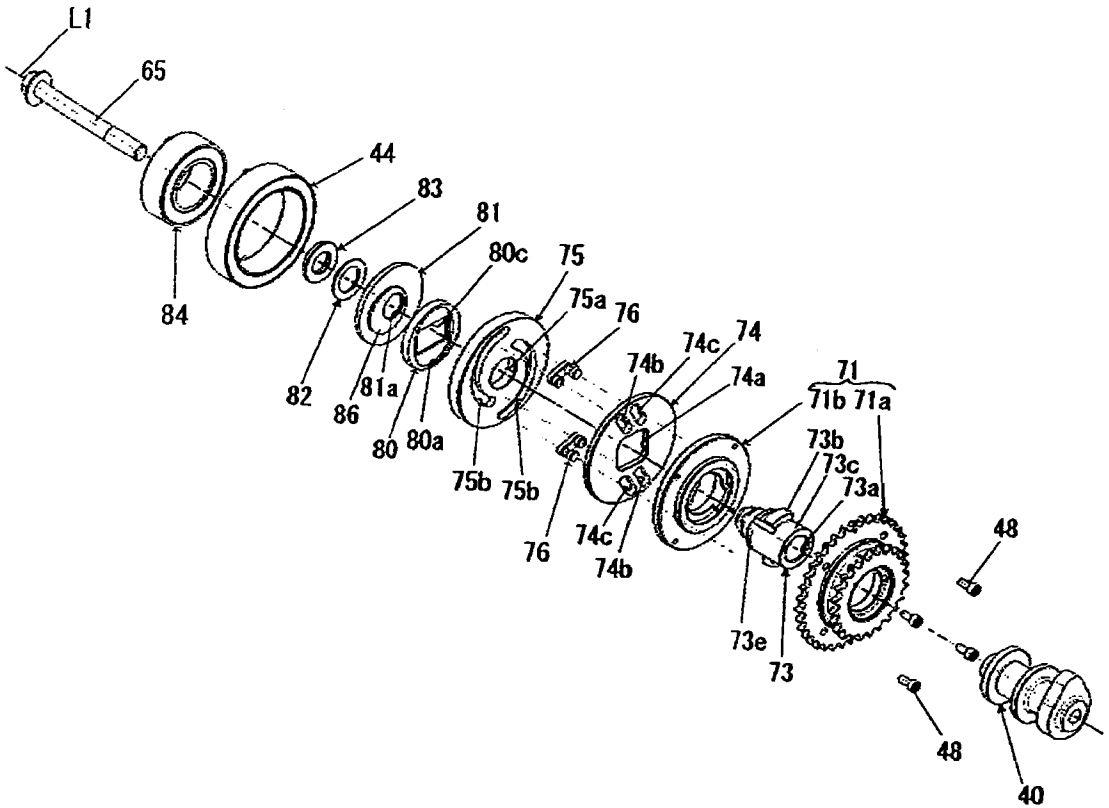
FIG. 12 is an exploded perspective view of the second controller taken from rear.
Figure 13:
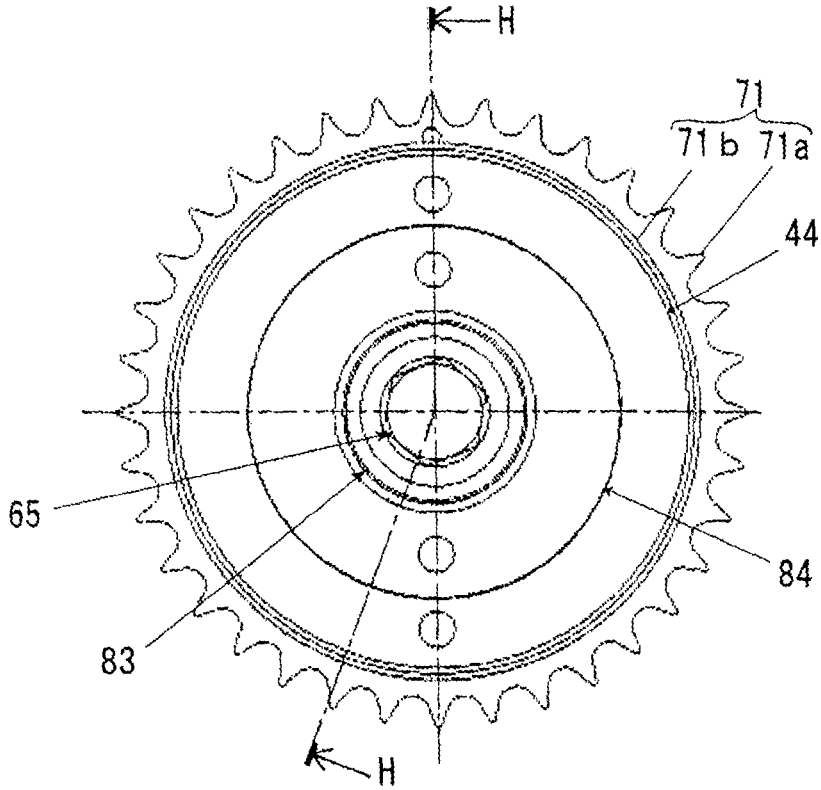
FIG. 13 is a front view of the second controller.
Figure 14:
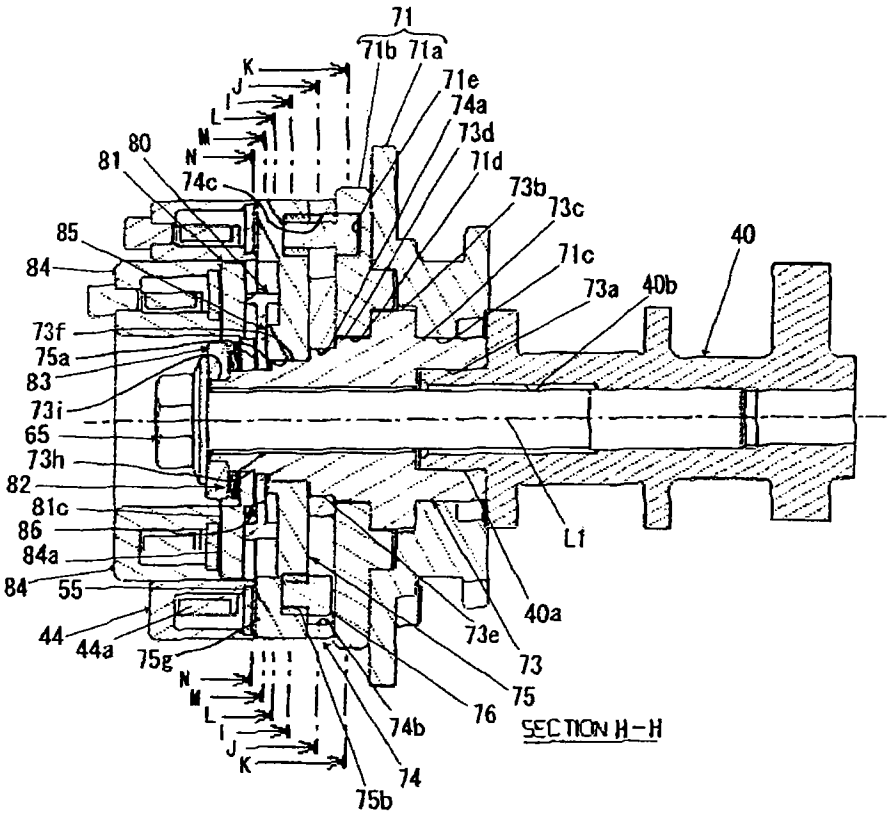
FIG. 14 is an axial cross sectional view of the second controller taken along line H-H of FIG. 13.
Figure 15:
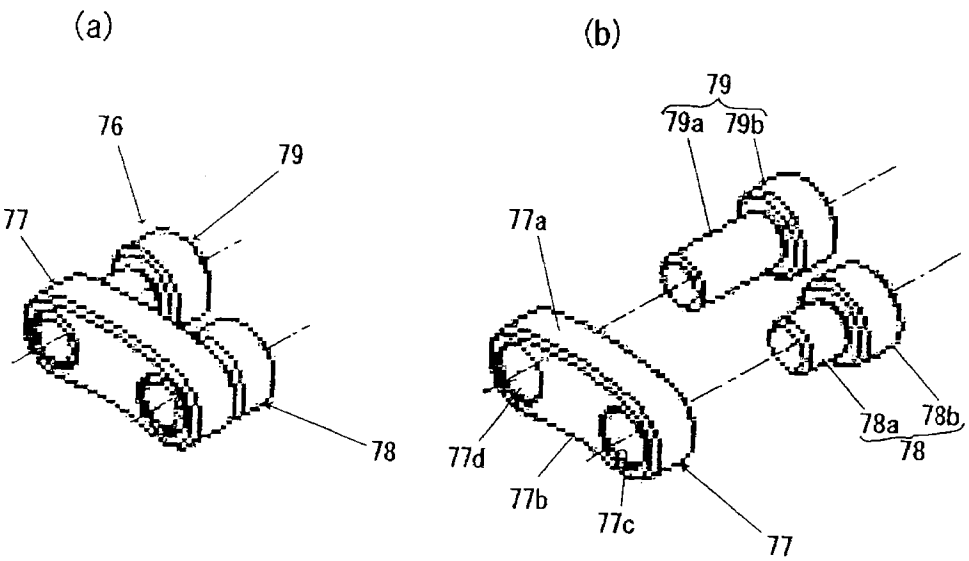
FIG. 15 is a diagram illustrating a phase conversion member for use with the controllers. More particularly, FIG. 15(*a*) is a perspective view of the phase conversion member, and FIG. 15(*b*) is an exploded perspective view of the phase conversion member.
Figure 16:
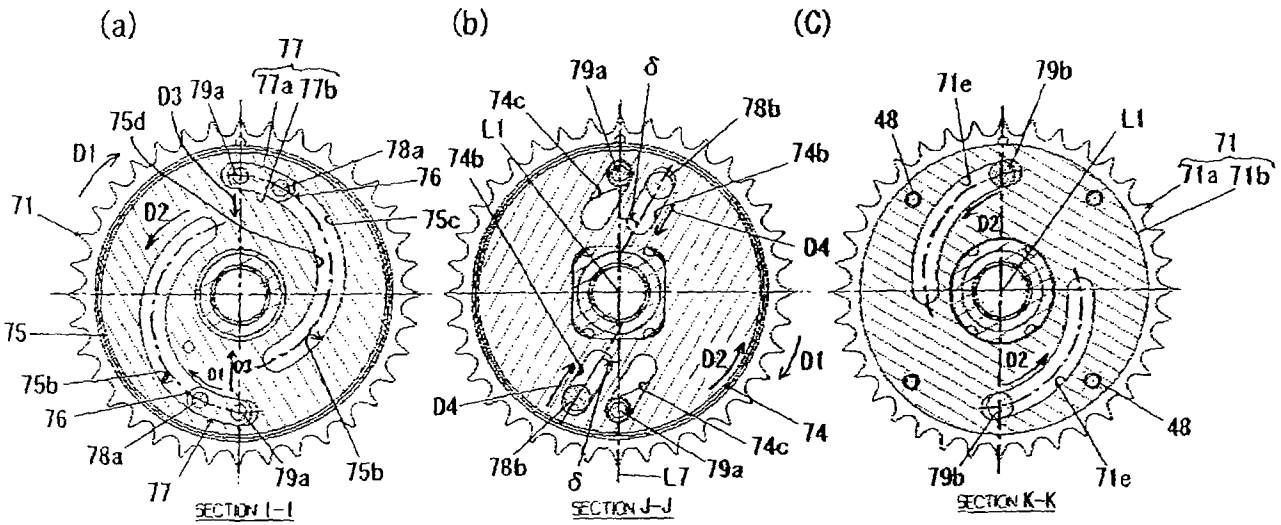
FIG. 16 is a radial cross sectional view of the variable phase controller. More particularly, FIG. 16(*a*) is a cross sectional view taken along line I-I of FIG. 14.
Figure 17:
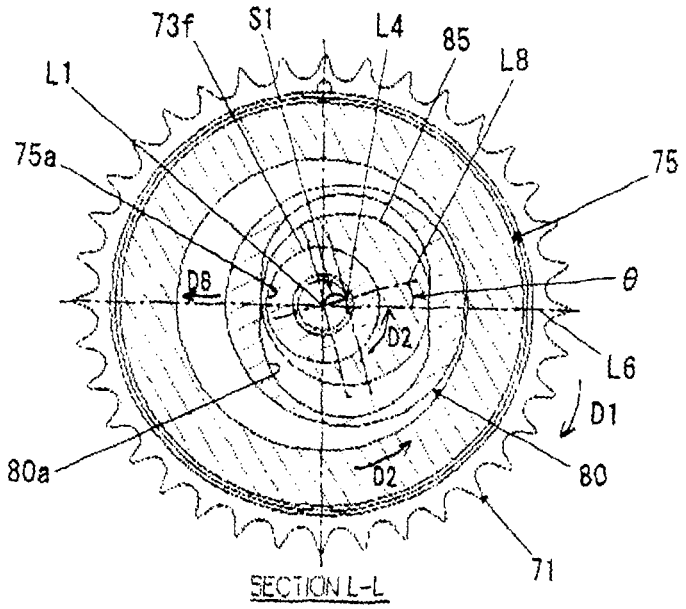
FIG. 17 is a cross sectional view of the first circular eccentric cam taken along line L-L of FIG. 14.
Figure 18:
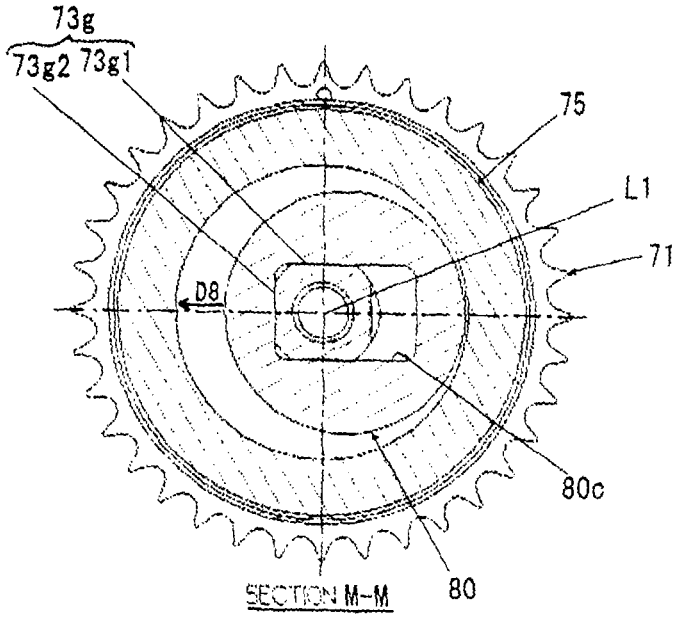
FIG. 18 is a vertical cross sectional view of the cam guide plate taken along line M-M of FIG. 14.
Figure 19:
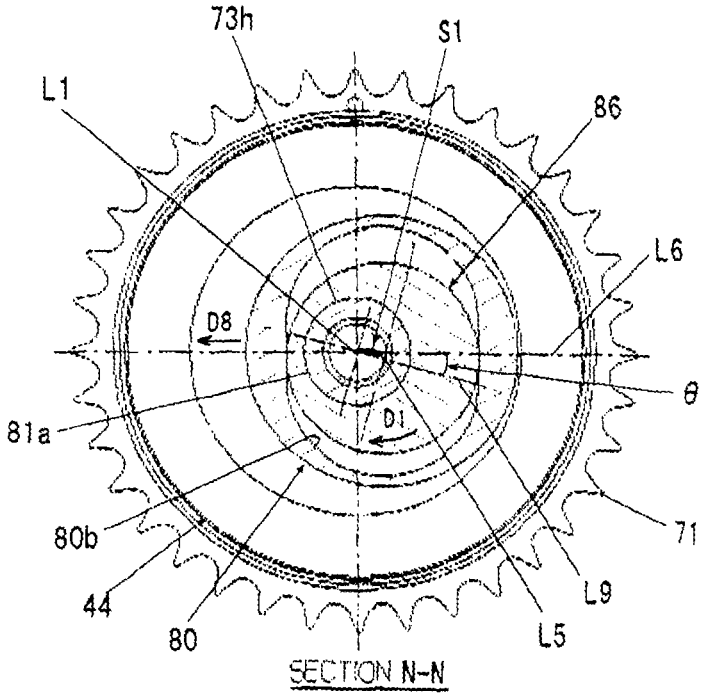
FIG. 19 is a cross sectional view of the second circular eccentric cam taken along line N-N of FIG. 14.

40 camshaft
41 and 71 drive rotor
43 and 73 first intermediate rotor
44 first electromagnetic clutch (first braking means)
45 and 75 first control rotor
56 second intermediate rotor
57 and 81 second control rotor
60 and 84 second electromagnetic clutch (second braking means)
61 first guide grooves
62 second guide grooves
63 radial guide grooves
64 slide pins (movable members)
80 cam guide plate
80*a* and 80*b* oblong circular bores of the cam guide plate
85 first circular eccentric cam
86 second circular eccentric cam
L1 rotational axis
L4 cam center of the first circular eccentric cam
L5 cam center of the second circular eccentric cam
L8 line connecting L1 and L4
L9 line connecting L1 and L5
D1 phase-lead direction (rotational direction of the drive rotor)
D2 phase-lag direction (direction opposite to the rotational direction of the drive rotor)

The invention claimed is:

1. A variable phase controller for an automotive engine, including a drive rotor driven by a crankshaft of the engine, an intermediate rotor integral with a camshaft, and a first control rotor such that the drive rotor, intermediate rotor, and first control rotor are aligned to a common rotational axis and rotatable relative to each other, and including torque means for rotating the first control rotor relative to the drive rotor and the first intermediated rotor, wherein the first intermediate rotor and the first control rotor rotated relative to each other in accordance with the direction of the relative rotation of the first control rotor to thereby change the phase angle of the camshaft relative to the drive rotor, the variable phase controller characterized in that the torque means comprises:

first guide grooves formed in the first control rotor each extending in a substantially circumferential direction with a continuously decreasing radius;

a first braking means for rotating the first control rotor relative to the first intermediate rotor and drive rotor;

a second intermediate rotor integral with the camshaft and having guide slits extending in substantially radial directions, the second intermediate rotor being coaxially disposed adjacent to, and rotatable relative to, the first control rotor;

a second control rotor formed with second guide grooves each extending in the opposite direction with respect to the first guide grooves with a continuously decreasing radius, second control rotor mounted coaxial with, and rotatable relative to, the second intermediate rotor;

second braking means for rotating the second control rotor relative to the second intermediate rotor and first control rotor; and movable members adapted to engage the first guide grooves, radial guide grooves, and second guide grooves and move in the respective guide grooves in accordance with the relative rotation of the first control rotor and second control rotor.

2. A variable phase controller for an automotive engine, including a drive rotor driven by the crankshaft of the engine, an intermediate rotor integral with a camshaft, and a first control rotor such that the drive rotor, intermediate rotor, and first control rotor are all aligned to a common rotational axis and rotatable relative to each other, and including torque means for rotating the first control rotor relative to the drive rotor and the first intermediated rotor, with the first intermediate rotor and the first control rotor being adapted to be rotated relative to each other in accordance with the direction of the relative rotation of the first control rotor, to thereby change the phase angle of the camshaft relative to the drive rotor, the variable phase controller characterized in that the torque means comprises:

first brake means for rotating the first control rotor relative to the first intermediate rotor and drive rotor;

a first circular eccentric cam protruding from the first control rotor in the direction of the rotational axis, and having a central axis offset from the rotational axis;

a second control rotor having a second circular eccentric cam protruding in the direction of the rotational axis and having a central axis offset from the rotational axis, the second control rotor being coaxial with, and rotatable relative to, the first control rotor;

a cam guide plate having a pair of oblong circular bores each extending in the direction substantially perpendicular to the axis of the camshaft and adapted to receive therein the first circular eccentric cam and second circular eccentric cam such that the cams are freely movable in the longitudinal direction of the oblong bores, the cam guide plate unrotatably supported by the camshaft, but freely movable in the direction substantially perpendicular to the longitudinal direction of the oblong bores and the axial direction of the camshaft; and second braking means for rotating the second control rotor relative to the cam guide plate and the first control rotor, the first and second circular eccentric cams arranged such that the lines connecting the respective cam centers and the rotational axis are inclined with respect to the freely movable direction of the cam guide plate, and arranged substantially symmetric with respect to the freely movable direction.

* * * * *